US006250629B1

(12) United States Patent
Brown et al.

(10) Patent No.: US 6,250,629 B1
(45) Date of Patent: Jun. 26, 2001

(54) MAILPIECE STACKING SYSTEM AND METHOD

(75) Inventors: Michael A. Brown, Norwalk; Mark M. Oefinger, Bristol; John Nobile, Fairfield, all of CT (US)

(73) Assignee: Ascom Hasler Mailing Systems, Inc., Shelton, CT (US)

( * ) Notice: Subject to any disclaimer, the term of this patent is extended or adjusted under 35 U.S.C. 154(b) by 0 days.

(21) Appl. No.: 09/204,788

(22) Filed: Dec. 3, 1998

(51) Int. Cl.[7] ..... B65H 31/26
(52) U.S. Cl. ..... 271/220; 212/177; 212/207
(58) Field of Search ..... 271/220, 117, 271/207; 414/788.1

(56) References Cited

U.S. PATENT DOCUMENTS

| | | | | |
|---|---|---|---|---|
| 4,056,264 | * | 11/1977 | Dhooge et al. | 271/177 |
| 4,838,539 | | 6/1989 | Zimmerman | 271/305 |
| 5,137,415 | | 8/1992 | Doeberl et al. | 414/798.5 |
| 5,186,452 | | 2/1993 | Holbrook | 271/216 |
| 5,241,353 | * | 8/1993 | Maeshima et al. | 271/207 |
| 5,244,344 | | 9/1993 | Doeberl et al. | 414/798.2 |
| 5,332,210 | | 7/1994 | Silverberg et al. | 271/220 |
| 5,357,104 | | 10/1994 | Bleich | 250/229 |
| 5,364,090 | | 11/1994 | Hollis et al. | 271/216 |
| 5,464,317 | | 11/1995 | Foster et al. | 414/798.2 |
| 5,467,974 | * | 11/1995 | Ishiwata et al. | 271/220 |
| 5,575,580 | | 11/1996 | Parrish et al. | 403/49 |
| 5,615,995 | | 4/1997 | Nobile et al. | 414/798.2 |
| 5,709,525 | | 1/1998 | Marzullo et al. | 414/798.7 |
| 5,779,496 | | 7/1998 | Bolinger et al. | 439/377 |
| 6,022,018 | * | 2/2000 | Zimmermann et al. | 271/220 |

* cited by examiner

*Primary Examiner*—Thomas J. Brahan
(74) *Attorney, Agent, or Firm*—James F. McLaughlin; Perman & Green, LLP

(57) ABSTRACT

In a mailpiece stacking system, a pressure pad is used to direct incoming mailpieces from a mailing machine used with the system onto a feed deck, where the mailpieces are stacked against a stacking wall in the system. To properly handle mailpieces including window envelopes, the length of the pressure pad is selected in accordance with the invention such that it effectively deflects each mailpiece to land beyond the window part of any window envelope preceding thereto on the feed deck. Advantageously, the risk of having the mailpiece getting caught by an edge of the window part, resulting in a congestion, is avoided. In addition, among other things, a catch nub is included in the pressure pad for hooking onto a stub shaft mounted on the frame of the system. The nub hooks onto the stub shaft when the pressure pad is raised to allow it to stay in the raised position. Moreover, to effectively attach the stacking system to the mailing machine, the stacking system provides thereunder a hook having a C-shaped opening. The hook is used to be slidably engaged with a support knob underneath the mailing machine through the opening. The resulting engagement aligns the mailing machine with the stacking system to allow proper feeding of the mailpieces from the mailing machine to the stacking system, notwithstanding the vibrations occasioned by the operation of the mailing machine and the stacking system.

40 Claims, 5 Drawing Sheets

MAILPIECE STACKING SYSTEM AND METHOD

FIELD OF THE INVENTION

The present invention relates to stacking systems and methods, and more particularly to systems and methods for stacking mailpieces processed by a postage meter or franking machine.

BACKGROUND OF THE INVENTION

Use of a postage meter to frank postage on mailpieces is ubiquitous. A stacking system is often used to efficiently assemble the mailpieces after they are processed by the postage meter. One such stacking system is disclosed in U.S. Pat. No. 5,615,995, issued Apr. 1, 1997 to Nobile et al. (hereinafter "the Nobile patent"), which is hereby incorporated by reference.

Specifically, the Nobile stacking system uses a pressure pad to direct mailpieces received from the postage meter onto a set of conveyance belts in the system to cause consecutive mailpieces to be arranged in a shingled overlapped relationship. The pressure pad is also used to exert force on the mailpieces to ensure feeding contact between the mailpieces and the conveyance belts. The conveyance belts transport the shingled mailpieces toward a stacking wall against which the mailpieces are pushed upwardly to form a stack.

SUMMARY OF THE INVENTION

Although it is advantageous to use a pressure pad in a stacking system, e.g., the Nobile stacking system, to help assemble mailpieces, it has been recognized that a prior art pressure pad actually causes problems in certain applications. One such problem arises when the prior art pressure pad is used in a stacking system collecting mailpieces that include window enveloped mailpieces, hereinafter simply referred to as "window envelopes." In particular, in assembling a stream of mailpieces, the prior art pressure pad deflects each mailpiece at such a sharp angle that its leading edge would land on the window part of any window envelope preceding the mailpiece. Consequently, the mailpiece gets caught by an edge of the window of the window envelope as the mailpiece and the window envelope are being pushed against the stacking wall. The mailpiece that gets caught invariably causes a congestion in the midstream of the mailpieces to be assembled, resulting in a disheveled pile at best. A prolonged congestion causes spilling of the succeeding mailpieces over the stacking system. Some of the mailpieces may even be deflected at the congestion off the stacking system, especially when the stacking system operates at a high speed. Disadvantageously, using the stacking system with the prior art pressure pad, the mailpieces to be assembled may get lost because of the spillover and/or deflection.

Thus, in accordance with the invention, the length of a pressure pad is selected such that the end thereof extends past the leading window edge of a deflected window envelope as it lands on the conveyance belts. As such, the leading edge of a succeeding mailpiece deflected by the pressure pad would land beyond the leading window edge of the window envelope, thereby effectively averting any unwanted congestion described above.

Another problem with the prior art pressure pad is that it causes mailpieces to be unevenly distributed by the conveyance belts. This problem stems from the fact that the prior art pressure pad comes in contact with the mailpieces on the conveyance belts too soon, before the last mailpiece deflected by the pressure pad fully settles on the conveyance belts.

Thus, in accordance with an aspect of the invention, a friction causing connector, e.g., a washer having coarse surfaces, is applied to the connection of the pressure pad to the stacking system for delaying the pressure pad from contacting the mailpieces until after the last deflected mailpiece fully settles on the conveyance belts.

It has also been recognized that a mailpiece stacking system, when used with a postage meter, normally needs to be manually attached to a mailing machine incorporating the postage meter. Such an attachment needs to be simple and convenient, without having to lift the mailing machine, which is significantly heavy. At the same time, the attachment needs to afford proper alignment of the stacking system with the mailing machine to allow efficient feeding of mailpieces from the mailing machine to the stacking system. In addition, such an alignment needs to withstand vibrations caused by the operation of the stacking system and the mailing machine.

Thus, in accordance with another aspect of the invention, a connector is provided underneath the stacking system for attaching it to the mailing machine. The connector, e.g., a hook having a C-shaped opening, is used to slidably and snugly hook onto a support knob on the underside of the mailing machine through the opening. Advantageously, using the inventive arrangement, the stacking system can be attached to, and thereby aligned with, the mailing machine on the same support surface without having to lift the mailing machine. Because of the tight fit of the hook onto the support knob, the risk of the stacking system and the mailing machine becoming misaligned due to vibrations occasioned by their operation is reduced.

Many mailing machines provide the option of printing out postage marked labels for putting onto bulk size mailpieces that are too large to be processed by the machines. When a prior art stacking system, e.g., the Nobile stacking system, is used with such mailing machines generating the postage marked labels, the pressure pad therein would peel the labels off their backing upon contacting the labels. Thus, it may be desirable to operate the stacking system with the pressure pad being raised when labels are generated, thereby preventing the pressure pad from contacting the labels.

Thus, in accordance with yet another aspect of the present invention, the pressure pad provides a catch nub for engaging with a stub shaft, mounted on the frame of the stacking system, when the pressure pad is raised to maintain its raised position. Preferably, the catch nub has a gradual angular surface such that it can be easily disengaged from the stub shaft with a mild downward force on the pressure pad. Accordingly, the pressure pad can readily be returned to the normal operative position.

DETAILED DESCRIPTION OF THE INVENTION

Figure 1:
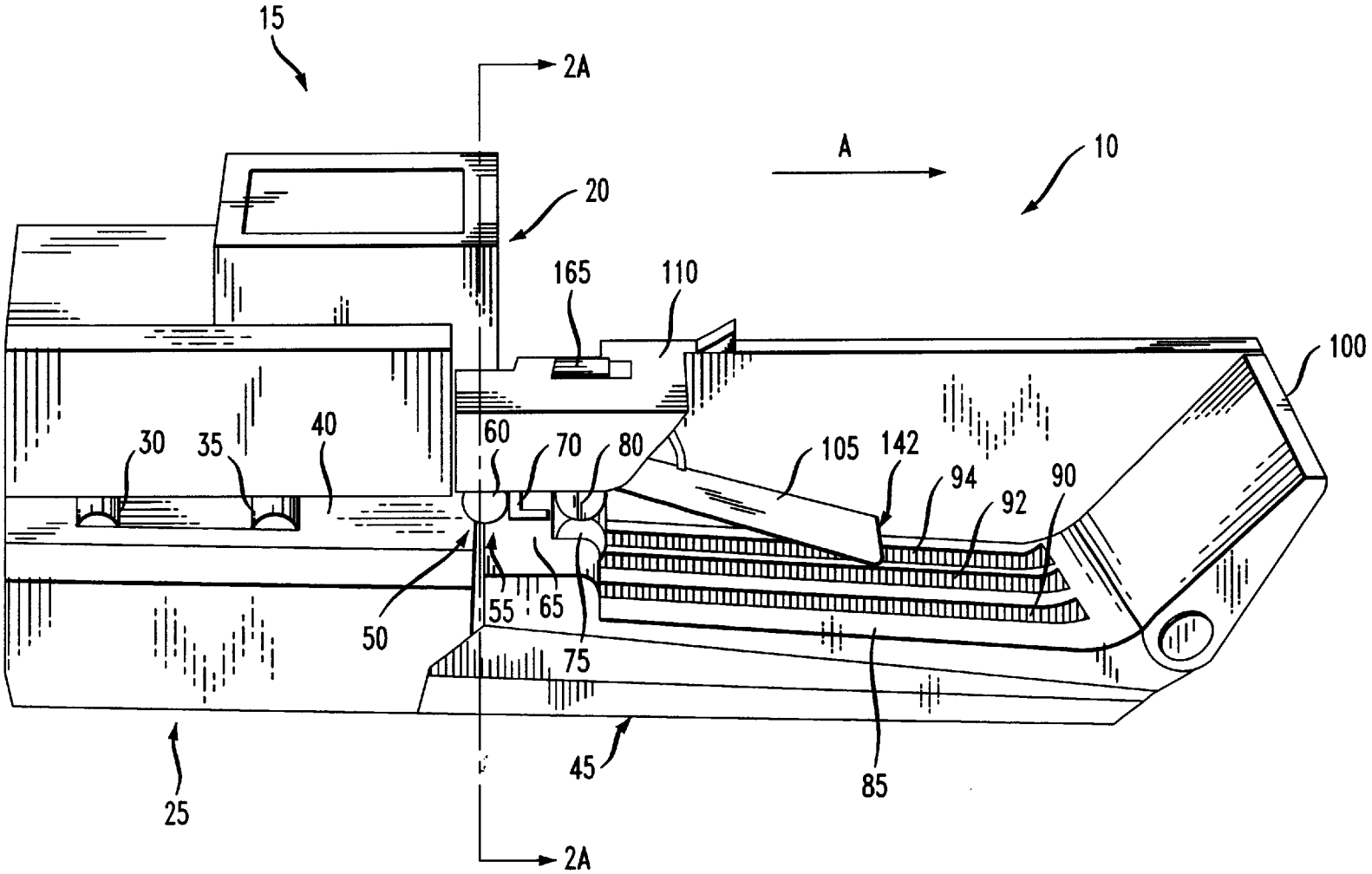
FIG. 1 is a perspective view of a stacking system in accordance with the invention for use with a typical mailing machine.

FIG. 1 illustrates stacking system 10 embodying the principles of the invention for assembling mailpieces processed by mailing machine 15 of conventional design. Mailing machine 15 includes postage meter 20 and feed base 25. In a conventional manner, mailpieces to be processed are fed by feed rollers 30 and 35 along feed deck 40 on feed base 25 through postage meter 20 for printing appropriate postage marks on the mailpieces as evidence of payment of postage. It should be noted that mailing machine 15 is shown for illustration purposes only, and that other mail processing machines, of various sizes and models, may be used in its place with stacking system 10.

As shown in FIG. 1, stacking system 10 comprises elongate frame 45 on which operable components of stacking system 10 are mounted. Mailpieces are ejected seriatim from outlet 50 of mailing machine 15 into inlet 55 of stacking system 10. In accordance with an aspect of the invention, guide wheels 60 and 62 (guide wheel 62 shown in FIG. 2A but not in FIG. 1) are used to receive and align the incoming mailpieces onto upper feed deck portion 65 through tongue 70 into the nip between feed roller 75 and pressure roller 80.

The mailpieces are pulled by feed roller 75 from upper feed deck portion 65 through the nip between feed roller 75 and pressure roller 80. Parallel conveyance belts 90, 92, and 94 extend over the length of lower feed deck portion 85 for receiving the mailpieces that emerge from the nip between rollers 75 and 80. Conveyance belts 90, 92, and 94 transport the mailpieces from upstream to downstream in direction A toward stacking wall 100. Pressure pad 105, pivotally connected to housing portion 110 of frame 45, extends along a portion of conveyance belts 90, 92, and 94. Pressure pad 105 controllably deflects mailpieces exiting the nip between rollers 75 and 80 down onto conveyance belts 90, 92, and 94. Pressure pad 105 also exerts generally vertical force on the mailpieces disposed on conveyance belts 90, 92, and 94 to effectively urge the mailpieces into contact with conveyance belts 90, 92, and 94 to be transported thereby. Stacking wall 100 is disposed at the downstream end of feed deck portion 85 against which the mailpieces are stacked in a generally upward angle. For accommodating mailpieces of different size and thickness, stacking wall 100 may be pivotally and/or laterally movable.

Figure 2A:
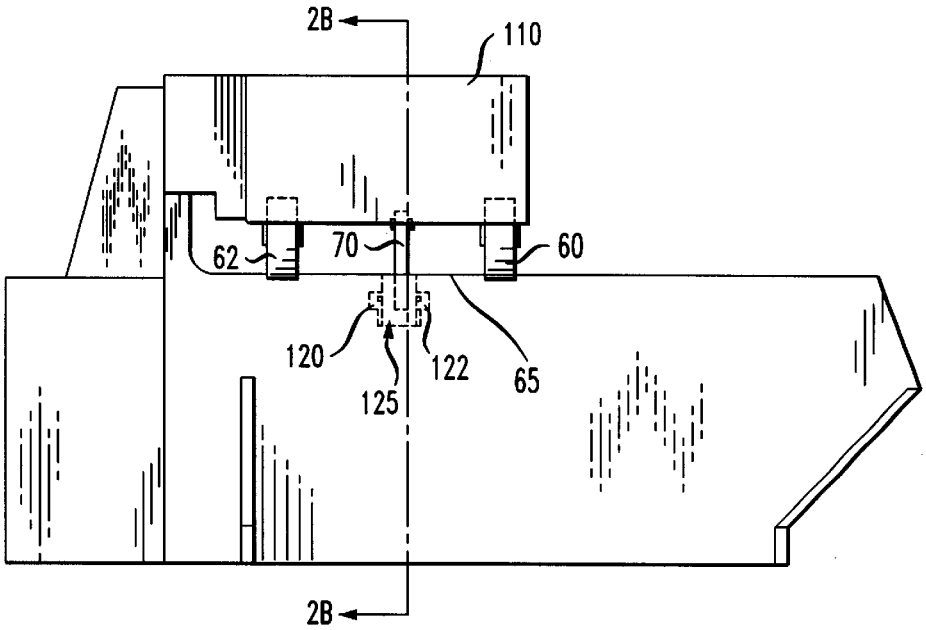
FIG. 2A provides a cross-sectional view of the stacking system of FIG. 1 taken from its inlet, where mailpieces enter.
Figure 2B:
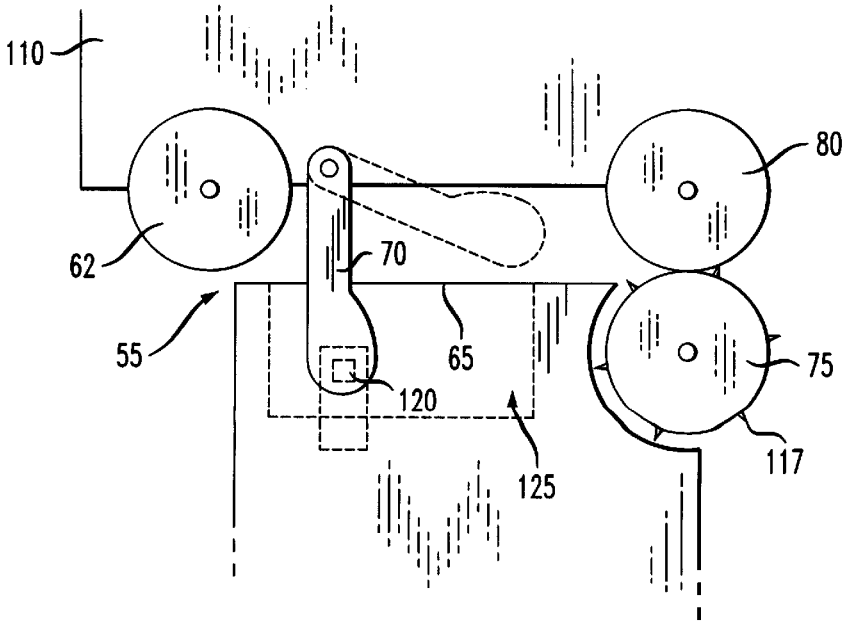
FIG. 2B illustrates a mechanism for receiving mailpieces at the inlet of the stacking system.

FIG. 2A provides a view of inlet 55 of stacking system 10 taken from the line 2*a*—2*a* of FIG. 1. FIG. 2B is a cross-sectional view through housing portion 110 over feed deck portion 65 of stacking system 10 taken from the line 2*b*—2*b* of FIG. 2A. Guide wheels 60 and 62 are disposed on opposite sides across inlet 55 and biased downwardly to exert force onto an incoming mailpiece to ensure proper horizontal alignment of the incoming mailpiece as described before.

Feed roller 75 and pressure roller 80 are arranged in a driving engagement where feed roller 75 pulls the incoming mailpiece forward. Feed roller 75 is driven by a drive mechanism of conventional design, which is housed within frame 45. It is important to note that a mailpiece ejected from mailing machine 15 maintains a propagation speed, and the circumferencial speed, $r\omega$, of roller 75 as driven is higher than such a propagation speed to create a pull on the mailpiece, where r and $\omega$ represent the radius and the angular velocity of roller 75, respectively. Multiple projections (a representative one of which is denoted 117 in FIGS. 2B and 3) extend outward in the radial direction slightly beyond the periphery of feed roller 75. Such projections are used to forcibly urge the trailing edge of the mailpiece downwardly towards conveyance belts 90, 92, and 94 as the mailpiece exits from the nip between rollers 75 and 80.

In order to accommodate oversize mailpieces, it is preferable to incorporate three conveyance belts 90, 92, and 94 parallel to one another, as shown in FIG. 1. It is important that the upstream end of conveyance belts 90, 92, and 94 extend to the point where the leading edge of a mailpiece exits the nip between rollers 75 and 80. This ensures that the leading edge of the mailpiece lands on conveyance belts 90, 92, and 94. The downstream end of conveyance belts 90, 92, and 94 terminates close to stacking wall 100 to ensure that mailpieces lying on conveyance belts 90, 92, and 94 are fully transported up to stacking wall 100. Conveyance belts 90, 92, and 94 are also driven by the aforementioned drive mechanism. The linear velocity of conveyance belts 90, 92, and 94 is considerably less than that of a mailpiece exiting the nip between rollers 75 and 80 so that mailpieces landing on conveyance belts 90, 92, and 94 would form a shingled overlapped relationship with one another.

To further ensure that the mailpieces land on conveyance belts 90, 92, and 94 in a shingled overlapped relationship, it is necessary to prevent mailpieces from being transported by belts 90, 92, and 94 too far downstream before a succeeding mailpiece reaches belts 90, 92, and 94. To that end, an optical switch is used for controlling the drive mechanism driving roller 75 and belts 90, 92, 94. The drive mechanism is activated only when mailpieces are being ejected from mailing machine 15, triggering the optical switch.

FIGS. 2A and 2B show the optical switch, comprising tongue 70, light generator 120, and optical sensor 122. Light generator 120 and optical sensor 122 are hidden under the surface of feed deck portion 65. Light generator 120 faces optical sensor 122 across opening 125 such that an optical beam generated by light generator 120 would be received by optical sensor 122, provided that the optical beam is not blocked. In fact, when the optical switch is in the normal "off" position, such a light beam is blocked by tongue 70. The latter, made of opaque plastic material, is pivotally connected to housing portion 110 and extends therefrom down into opening 125. Such a pivotal connection allows tongue 70 to pivot between a light-blocking position, corresponding to the "off" position of the optical switch (shown in solid lines in FIG. 2B), and a non-light-blocking position, corresponding to the "on" position of the optical switch (shown in dash-dotted lines). Tongue 70 is normally biased towards the light-blocking position. During operation, the leading edge of a mailpiece ejected from mailing machine 15 pushes tongue 70, thereby unblocking the beam from generator 120 to sensor 122. As soon as sensor 122 detects the beam across opening 125, the optical switch causes the drive mechanism to be activated.

Tongue 70 is urged back to the light-blocking position as the trailing edge of the last mailpiece is no longer in contact with tongue 70. Accordingly, the drive mechanism is deactivated by the optical switch at the end of a predetermined delay period after tongue 70 returns to the light-blocking position. Deactivating the drive mechanism at the end of the aforementioned delay period ensures that proper spacing of the shingled overlapped relationship between consecutive mailpieces is maintained, independent of the rate at which mailpieces are ejected from mailing machine 15. It should be noted that due to the design that light generator 120 and sensor 122 are hidden from the surface of feed deck portion 65, interference by ambient light with, or blockage by dust of, the light beam in the optical switch is desirably averted.

Figure 3:
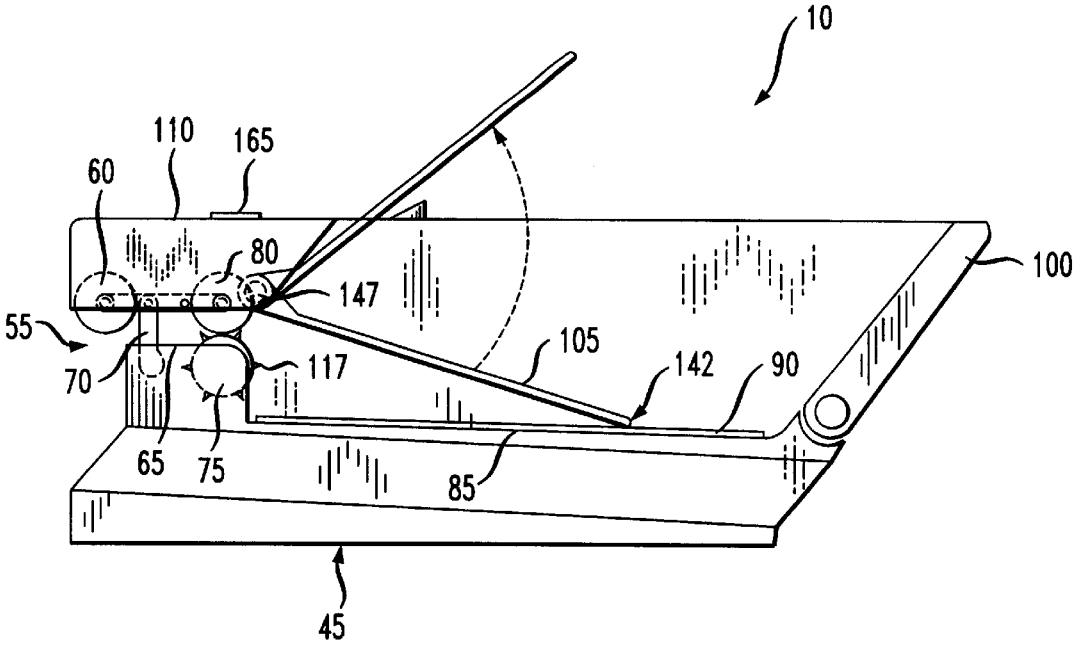
FIG. 3 illustrates the range of pivotal movement of the pressure pad in accordance with the invention.

Referring to FIG. 3, pressure pad 105 is pivotally connected to housing portion 110 of frame 45. This allows pressure pad 105 to pivot between the normal operative position, shown in solid lines, and the raised position, shown in dash lines, for reasons set forth below. When pressure pad 105 is in the normal operative position, it is disposed at an angle to the plane of conveyance belts 90, 92, and 94 (shown in FIG. 1). Pad 105 intercepts mailpieces exiting from the nip between rollers 75 and 80 and controllably deflects the leading edges of the mailpieces downwardly toward conveyance belts 90, 92, and 94.

It has been recognized that a prior art pressure pad presents substantial problems when it is used to direct mailpieces which include window envelopes in the stacking system, e.g. system 10. In particular, in assembling a stream of mailpieces, the prior art pressure pad deflects each mailpiece at such a sharp angle that its leading edge would land on the window part of any window envelope preceding to the mailpiece. Consequently, the mailpiece gets caught by an edge of the window of the window envelope as the mailpiece and the window envelope are being pushed up against stacking wall 100. The mailpiece that gets caught invariably causes a congestion in the midstream of the mailpieces to be assembled, resulting in a disheveled pile at best. A prolonged congestion causes spilling of the succeeding mailpieces over stacking system 10. Some of the mailpieces may even be deflected at the congestion off stacking system 10 especially when system 10 operates at a high speed. Disadvantageously, using stacking system 10 with the prior art pressure pad, the mailpieces to be assembled may get lost because of the spillover and/or deflection.

Figure 4A:
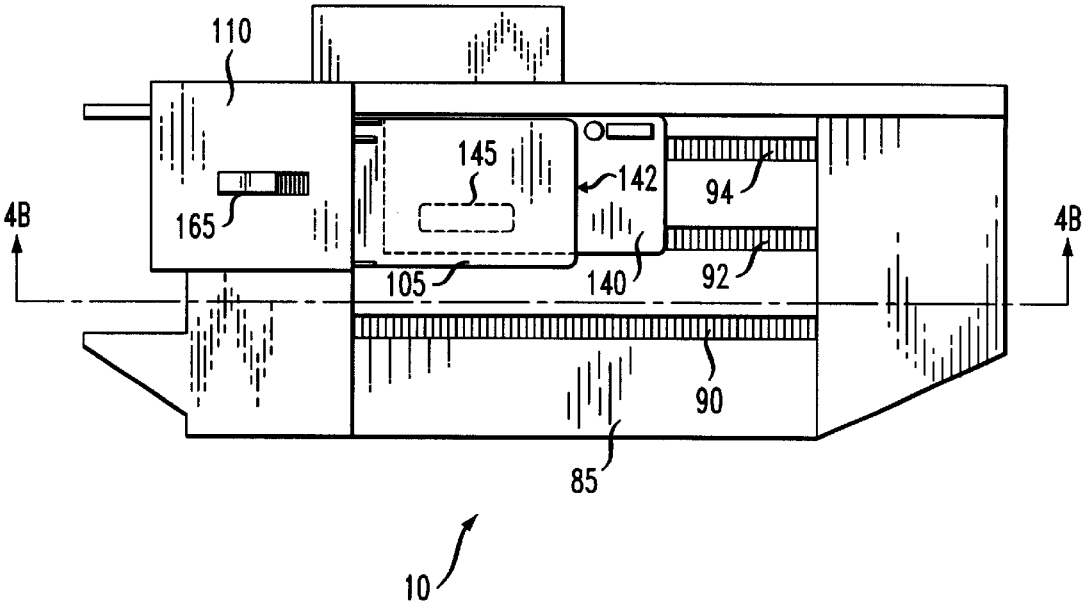
FIG. 4A provides a top view of the stacking system processing a window envelope.
Figure 4B:
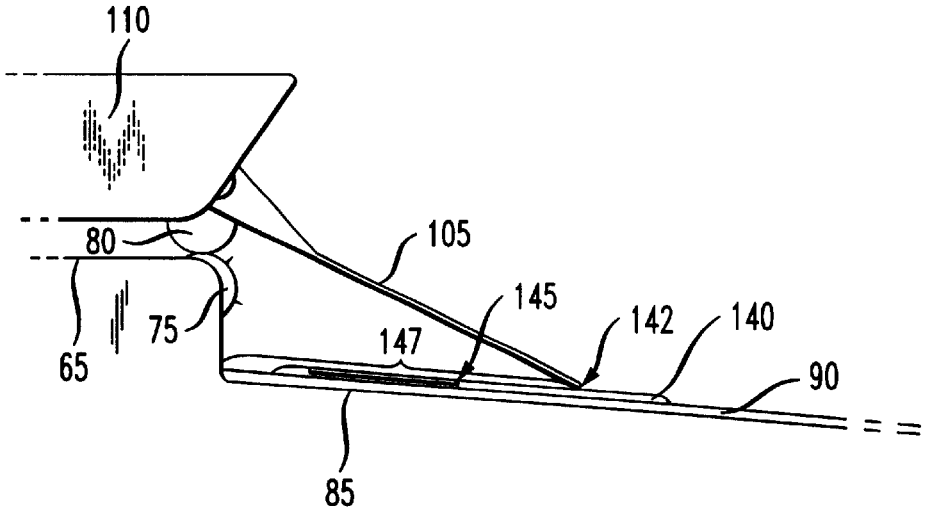
FIG. 4B illustrates a relationship between the pressure pad and the window envelope in accordance with the invention.

In accordance with the invention, a pressure pad, e.g., pressure pad 105, of a selected length is used. FIG. 4A is a top view of stacking system 10 showing the position of window envelope 140 after it is deflected by pad 105 onto feed deck portion 85. The length of pressure pad 105 is selected such that the end thereof, denoted 142, extends past leading window edge 145 of window envelope 140. Thus, shown in FIG. 4B, which provides a view taken from line 4*b*—4*b* of FIG. 4A, projection 147 of pressure pad 105 onto feed deck portion 85 extends beyond leading window edge 145 of window envelope 140 in accordance with the invention. As such, the leading edge of the succeeding mailpiece deflected by pad 105 would land beyond leading window edge 145, thereby effectively averting any unwanted congestion described above.

In addition, it has been recognized that the prior art pressure pad causes mailpieces to be unevenly distributed by conveyance belts 90, 92, and 94, stemming from the fact that the prior art pressure pad comes in contact with the mailpieces too soon, before the last mailpiece ejected from roller 75 fully settles on portion 85. Referring to FIGS. 3, 5A, 5B, and 5C, in accordance with the invention, a friction-causing connector, e.g., washer 147 having coarse surfaces, is connected between housing portion 110 and at least one of connecting members 150 and 155 of pressure pad 105 to increase, by a controllable amount, the friction of the pivotal connection of pressure pad 105 to housing portion 110. As a mailpiece impacts pressure pad 105 and is deflected thereby onto portion 85, pad 105 is temporarily pushed up to form a small gap between its end 142 and the shingled mailpieces already on portion 85. The increased friction caused by washer 147 delays pressure pad 105 from landing back on the mailpieces until after the just deflected mailpiece has substantially settled on portion 85, thereby allowing the mailpieces to align properly and correcting the uneven distribution described above.

The mechanism for controllably urging pressure pad 105 against mailpieces on portion 85, which involves interactions between protruding arm 160, stub shaft 162, a torsion spring (not shown), and finger button 165 (shown in FIGS. 1 and 3), is fully described in the Nobile patent, and its description is thus omitted here. It is sometimes desirable to operate stacking system 10 with pressure pad 105 being raised (shown in a dash line position in FIG. 3). One such occasion is when stacking system 10 is fed with postage labels generated by mailing machine 15. Many mailing machines provide the option of printing postage marks on labels for putting onto bulk size mailpieces which are too large to be processed by the machines. When a prior art stacking system, e.g., the Nobile stacking system, is used with such mailing machines generating the postage marked labels, the pressure pad therein would peel the labels off their backing upon contacting the labels. Thus, it may be desirable to operate the stacking system with the pressure pad being raised when labels are being generated, thereby preventing the pressure pad from contacting the labels.

Figure 5A:
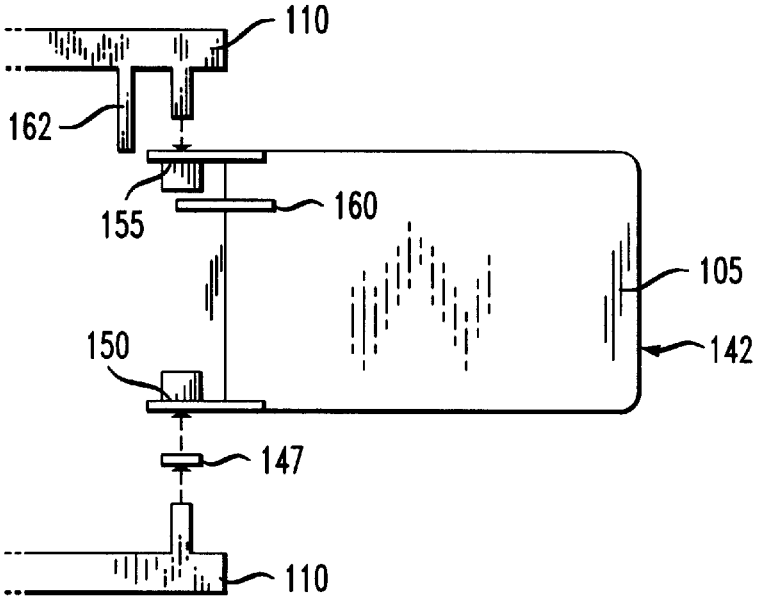
FIG. 5A illustrates the connection of the pressure pad to the stacking system.
Figure 5B:
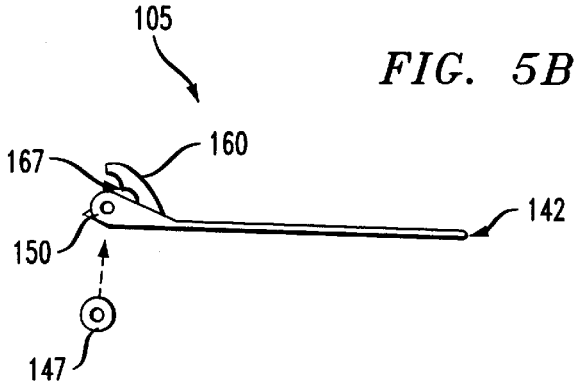
FIG. 5B provides a side view of the pressure pad.
Figure 5C:
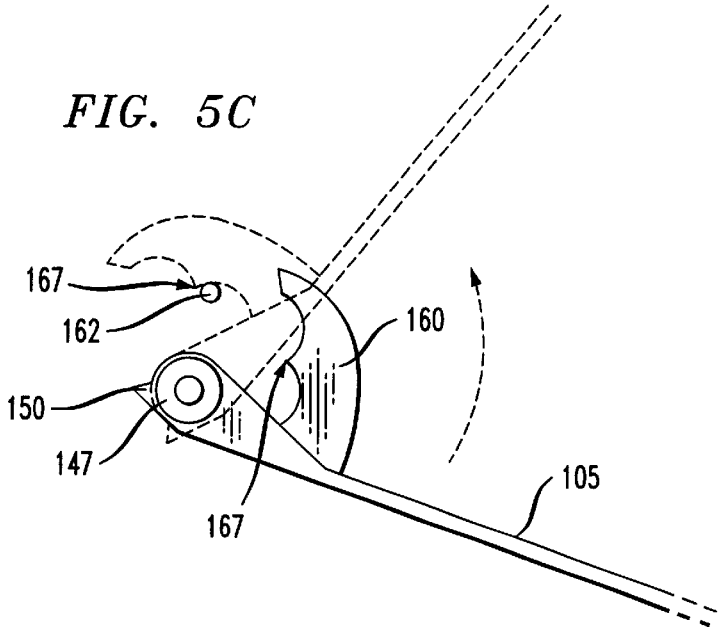
FIG. 5C illustrates an interaction at the connection between the pressure pad and the stacking system.

In accordance with the invention, protruding arm 160, as shown in FIG. 5B, provides pointed nub 167 to form a serrated surface on arm 160. FIG. 5C shows a side view of a pivotal connection of pressure pad 105 to housing portion 110, with both the solid line operative position and dash line raised position of pad 105 shown. When pad 105 is in the raised position, protruding arm 160 extends over and around stub shaft 162 to engage pointed nub 167 with stub shaft 162, thereby maintaining the raised position. It should be noted that pointed nub 167 has a selected sharpness so that nub 167 can readily be disengaged from stub shaft 162 to return pressure pad 105 to the operative position.

It has also been recognized that a mailpiece stacking system, e.g., system 10, typically needs to be manually attached to a mailing machine, e.g., machine 15, to process mailpieces. However, such an attachment needs to be simple and convenient, without having to lift mailing machine 15, which is significantly heavy. At the same time, the attachment needs to afford proper alignment of stacking system 10 with the mailing machine 15 to allow efficient feeding of mailpieces from machine 15 to system 10. In addition, such an alignment needs to withstand vibrations caused by the operation of system 10 and machine 15.

Figure 6:
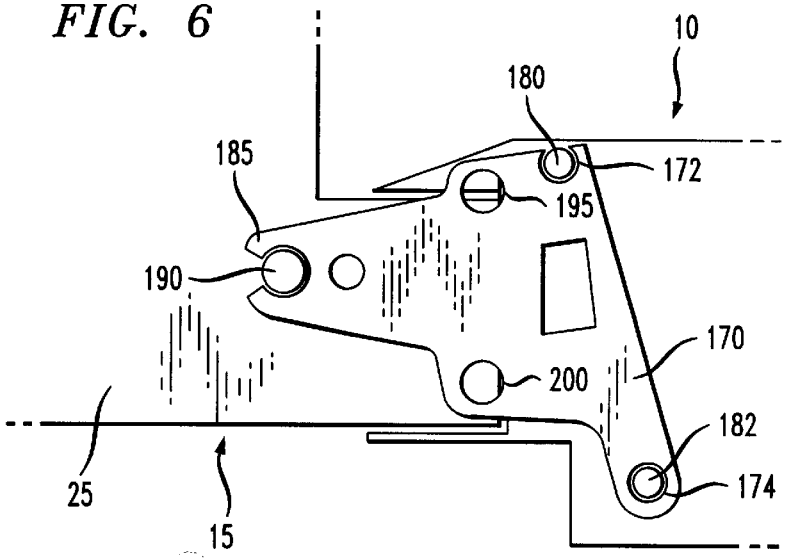
FIG. 6 illustrates a mechanism whereby the stacking system is attached to the mailing machine, in accordance with the invention.

Referring to FIG. 6, foot stand 170 in accordance with the invention is placed underneath stacking system 10 for attaching system 10 to mailing machine 15 by its base 25. Stand 170 provides holes 172 and 174 for accommodating support knobs 180 and 182 of stacking system 10, respectively. In accordance with the invention, stand 170 also provides a connector, e.g., hook 185 having a C-shaped opening, at the inlet end of stacking system 10. Hook 185 is used to engage with support knob 190 located at the outlet end of mailing machine 15. Operatively, stacking system 10 is put on top of stand 170 by coinciding holes 172 and 174 with support knobs 180 and 182, respectively. By pushing the inlet end of stacking system 10 towards the outlet end of mailing machine 15 on the same support surface until hook 185 snugly hooks onto support knob 190 through the C-shaped opening, system 10 is attachably aligned with machine 15. Advantageously, using the inventive arrangement, stacking system 10 can be attached to, and thereby aligned with, mailing machine 15 on the same support surface without having to lift machine 15. Because of the tight fit of hook 185 onto support knob 190, the risk of system 10 and machine 15 becoming misaligned due to vibrations occasioned by their operation is reduced. In an alternative embodiment, holes 195 and 200 accommodate the support knobs of a riser unit (not shown) that can be put between stacking system 10 and stand 170. This riser unit would allow stacking system 10 to be evenly connected to a taller mailing machine.

The foregoing merely illustrates the principles of the invention. It will thus be appreciated that those skilled in the art will be able to devise numerous other arrangements which embody the principles of the invention and are thus within its spirit and scope.

What is claimed is:

1. A system for processing a stream of mailpieces including at least a first mailpiece and a second mailpiece, the first mailpiece being adjacent to, and followed by, the second mailpiece, the first mailpiece having a window thereon, the window having a plurality of edges, the system comprising:

a deck at a relatively low level;

a mechanism for feeding the stream of mailpieces at a relatively high level toward an end of the deck; and a pad having a selected length, a particular end of the pad extending toward the end of the deck, the pad controllably deflecting the stream of mailpieces fed by the mechanism onto the deck, the first mailpiece being disposed on the deck in a position underneath the pad as the second mailpiece is deflected onto the first mailpiece, the length of the pad being selected so that the particular end of the pad also extends past a leading edge of the window of the first mailpiece in the position, the leading edge of the window being closest, of all of the edges of the window, to the end of the deck.

2. The system of claim 1 further comprising a transport for transporting the mailpieces on the deck.

3. The system of claim 2 wherein the transport comprises at least one conveyance belt.

4. The system of claim 1 further comprising a switching device for detecting at least one of the mailpieces entering the mechanism, and for controlling an activation of the mechanism depending on whether an entry of the at least one mailpiece to the mechanism is detected.

5. The system of claim 4 wherein the switching device deactivates the mechanism following a predetermined delay period after no entry of any mailpiece to the system is detected within the predetermined delay period.

6. The system of claim 4 wherein the switching device comprises an optical sensor for sensing a light beam.

7. The system of claim 6 wherein the switching device further comprises a light generator for generating the light beam.

8. The system of claim 7 wherein the switching device further comprises a tongue for controllably blocking the light beam.

9. The system of claim 8 further comprising a frame wherein the tongue is pivotally connected to the frame and extends below the high level where it blocks the beam from the light generator to the optical sensor.

10. The system of claim 1 wherein the mechanism comprises a feed roller for pulling the mailpieces therethrough.

11. The system of claim 10 wherein the feed roller comprises a plurality of projections extending radially from the feed roller for guiding the mailpieces.

12. A system for stacking a stream of mailpieces including at least a first mailpiece and a second mailpiece, the first mailpiece being adjacent to, and followed by, the second mailpiece, the first mailpiece having a window thereon, the window having a plurality of edges, the system comprising:

a wall against which the stream of mailpieces are stacked;

a transport, at a relatively low level, for transporting the stream of mailpieces toward the wall;

a mechanism for feeding the stream of the mailpieces at a relatively high level toward the wall; and a pad having a selected length, a particular end of the pad extending toward the wall, the pad controllably deflecting the stream of mailpieces fed by the mechanism onto the transport, the first mailpiece being disposed on the transport in a position underneath the pad as the second mailpiece is deflected onto the first mailpiece, the length of the pad being selected such that an end of a projection of the pad onto the transport extends past a leading edge of the window of the first mailpiece in the position, the end of the projection corresponding to the particular end of the pad, the leading edge of the window being closest, of all of the edges of the window, to the wall.

13. The system of claim 12 wherein the wall is pivotally movable.

14. The system of claim 12 wherein the wall is laterally movable.

15. The system of claim 12 wherein the transport comprises at least one conveyance belt.

16. The system of claim 12 further comprising a switching device for detecting at least one of the mailpieces entering the mechanism, and for controlling an activation of the transport depending on whether an entry of the at least one mailpiece to the mechanism is detected.

17. The system of claim 16 wherein the switching device deactivates the transport following a predetermined delay period after no entry of any mailpiece to the system is detected within the predetermined delay period.

18. The system of claim 16 wherein the switching device comprises an optical sensor for sensing a light beam.

19. The system of claim 18 wherein the switching device further comprises a light generator for generating the light beam.

20. The system of claim 19 wherein the switching device further comprises a tongue for controllably blocking the light beam.

21. The system of claim 20 further comprising a frame wherein the tongue is pivotally connected to the frame and extends below the high level where it blocks the beam from the light generator to the optical sensor.

22. The system of claim 12 wherein the mechanism comprises a feed roller for pulling the mailpieces therethrough.

23. The system of claim 22 wherein the feed roller comprises a plurality of projections extending radially from the feed roller for guiding the mailpieces.

24. A method for use in a system for processing a stream of mailpieces including at least a first mailpiece and a second mailpiece, the first mailpiece being adjacent to, and followed by, the second mailpiece, the first mailpiece having a window thereon, the window having a plurality of edges, the system including a deck at a relatively low level, the method comprising:

feeding the stream of mailpieces at a relatively high level toward an end of the deck; and controllably deflecting the stream of mailpieces onto the deck using a pad having a selected length, a particular end of the pad extending toward the end of the deck, the first mailpiece being disposed on the deck in a position underneath the pad as the second mailpiece is deflected onto the first mailpiece, the length of the pad being selected so that the particular end of the pad also extends past a leading edge of the window of the first mailpiece in the position, the leading edge of the window being closest, of all the edges of the window, to the end of the deck.

25. The method of claim 24 further comprising transporting the mailpieces on the deck.

26. The method of claim 24 further comprising detecting at least one of the mailpieces entering the system.

27. The method of claim 26 further comprising controlling the feeding of the stream of the mailpieces depending on whether an entry of the at least one mailpiece to the system is detected.

28. The method of claim 26 wherein the feeding is terminated following a predetermined delay period after no entry of any mailpiece to the system is detected within the predetermined delay period.

29. The method of claim 26 further comprising generating a light beam.

30. The method of claim 29 further comprising sensing the light beam in detecting the at least one mailpiece entering the system.

31. The method of claim 30 further comprising controllably blocking the light beam based on any entry of a mailpiece.

32. The method of claim 24 further comprising guiding the mailpieces onto the deck.

33. A method for use in a system for stacking a stream of mailpieces including at least a first mailpiece and a second mailpiece, the first mailpiece being adjacent to, and followed by, the second mailpiece, the first mailpiece having a window thereon, the window having a plurality of edges, the system including a wall against which the stream of mailpieces are stacked, and a transport, at a relatively low level, for transporting the mailpieces toward the wall, the method comprising:

feeding the stream of mailpieces at a relatively high level toward the wall; and controllably deflecting the stream of mailpieces onto the transport using a pad having a selected length, a particular end of the pad extending toward the wall, the first mailpiece being disposed on the transport in a position underneath the pad as the second mailpiece is deflected onto the first mailpiece, the length of the pad being selected so that an end of a projection of the pad onto the transport extends past a leading edge of the window of the first mailpiece in the position, the end of the projection corresponding to the particular end of the pad, the leading edge of the window being closest, of all the edges of the window, to the wall.

34. The method of claim 33 further comprising detecting at least one of the mailpieces entering the system.

35. The method of claim 34 wherein the transporting is controlled depending on whether an entry of the at least one mailpiece to the system is detected.

36. The method of claim 34 wherein the transporting is terminated following a predetermined delay period after no entry of any mailpiece to the system is detected within the predetermined delay period.

37. The method of claim 34 further comprising generating a light beam.

38. The method of claim 37 further comprising sensing the light beam in detecting the at least one mailpiece entering the system.

39. The method of claim 36 further comprising controllably blocking the light beam based on any entry of a mailpiece.

40. The method of claim 33 further comprising guiding the mailpieces onto the transport.

* * * * *